US009427839B2

(12) United States Patent
Breitkopf

(10) Patent No.: US 9,427,839 B2
(45) Date of Patent: Aug. 30, 2016

(54) LAPPING TOOL

(71) Applicant: Siemens Energy, Inc., Orlando, FL (US)

(72) Inventor: Harald W. Breitkopf, Pasadena, TX (US)

(73) Assignee: SIEMENS ENERGY, INC., Orlando, FL (US)

( * ) Notice: Subject to any disclaimer, the term of this patent is extended or adjusted under 35 U.S.C. 154(b) by 0 days.

(21) Appl. No.: 14/470,039

(22) Filed: Aug. 27, 2014

(65) Prior Publication Data

US 2016/0059374 A1 Mar. 3, 2016

(51) Int. Cl.

| | |
|---|---|
| ***B24B 9/00*** | (2006.01) |
| ***B24B 33/08*** | (2006.01) |
| ***B24B 37/02*** | (2012.01) |
| ***B24B 37/11*** | (2012.01) |

(52) U.S. Cl.

CPC ..... *B24B 33/081* (2013.01); *B24B 33/088* (2013.01); *B24B 37/02* (2013.01); *B24B 37/11* (2013.01)

(58) Field of Classification Search

CPC ..... B24B 9/007; B24B 15/02; B24B 15/04; B24B 15/00; B24B 15/06

USPC ..... 451/59, 461, 462, 557, 523–525, 344

See application file for complete search history.

(56) References Cited

U.S. PATENT DOCUMENTS

| | | | | | |
|---|---|---|---|---|---|
| 1,183,855 | A | * | 5/1916 | Clarkson | B23C 3/05 137/242 |
| 1,364,625 | A | * | 1/1921 | Eriksen | B24D 7/00 433/110 |
| 1,975,904 | A | * | 10/1934 | Ramey | B24B 15/00 409/178 |
| 2,153,521 | A | | 4/1939 | Indge et al. | |
| 2,632,984 | A | * | 3/1953 | Kaplan | B24B 15/02 451/430 |
| 3,039,242 | A | * | 6/1962 | Ellenbogen | B24B 15/00 451/415 |
| 4,117,566 | A | * | 10/1978 | Ward | A47L 25/00 15/210.1 |
| 4,223,485 | A | | 9/1980 | Largeteau | |
| 4,834,340 | A | | 5/1989 | Girdley | |
| 6,561,888 | B2 | | 5/2003 | Domanski et al. | |

* cited by examiner

*Primary Examiner* — Robert Rose

(57) ABSTRACT

A lapping tool for lapping sealing surfaces of a fitting used in a gas turbine. The tool includes a shaft having first and second ends and a longitudinal axis. A removable handle is attached to the first end and is oriented in a direction transverse to the axis. The tool also includes a removable lapping insert having an outwardly extending attachment portion that is attached to the second end of the shaft. The lapping insert includes a lapping surface which corresponds to the shape of a sealing surface of the fitting. In one embodiment, the lapping insert includes a cavity for receiving a cone portion of a fitting. Alternatively, the lapping insert includes a projection for insertion into a receptacle portion of a fitting.

13 Claims, 3 Drawing Sheets

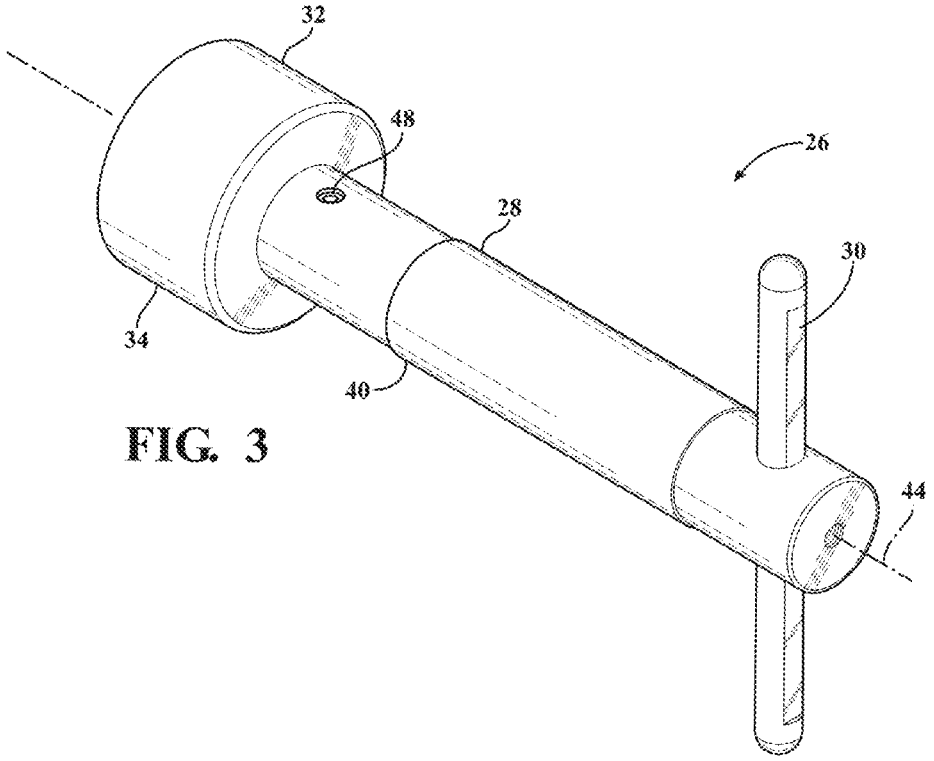
FIG. 3
FIG. 4
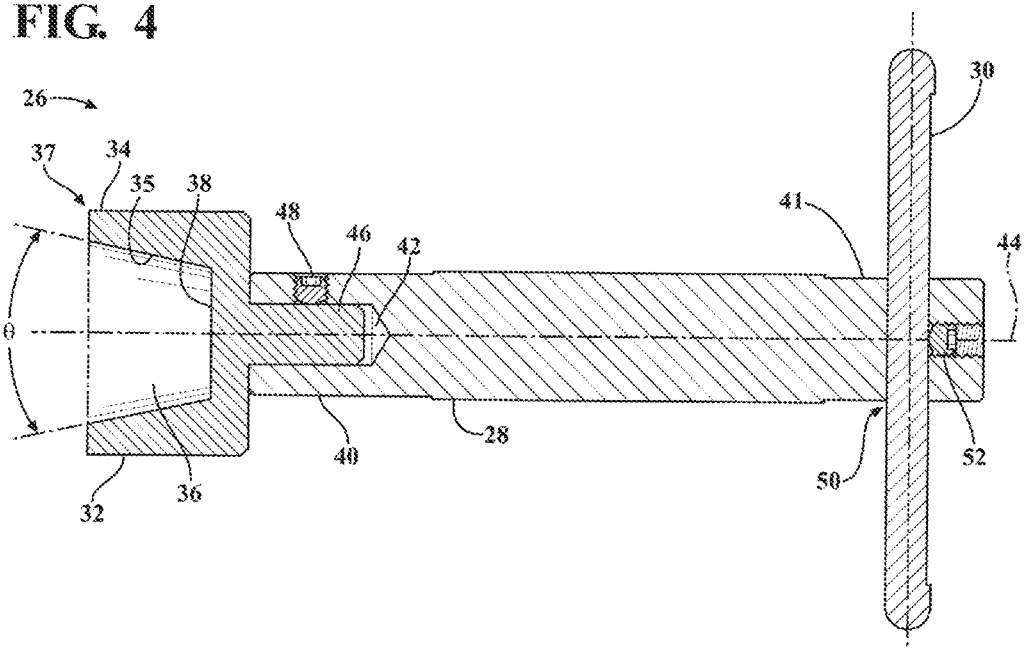

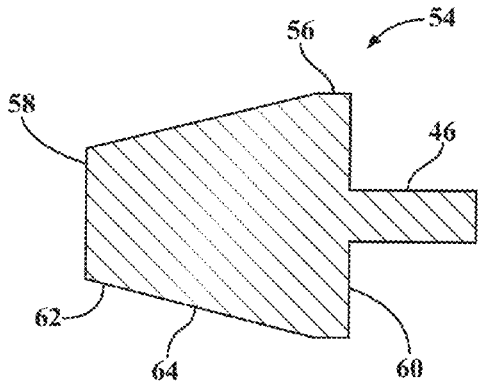
FIG. 5
FIG. 6
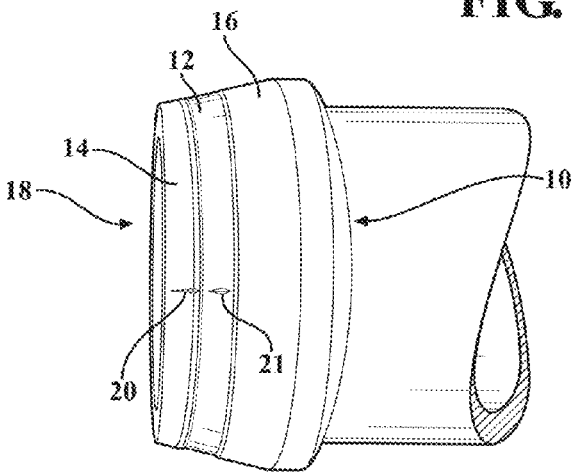
FIG. 7
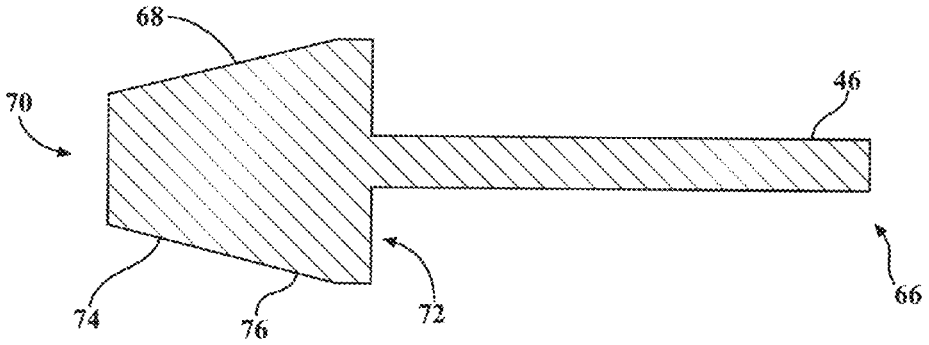

LAPPING TOOL

FIELD OF THE INVENTION

This invention relates to devices for lapping a surface, and more particularly, to a lapping tool having removable lapping inserts for lapping sealing surfaces of fittings used in a gas turbine.

BACKGROUND OF THE INVENTION

Fuel supply lines are attached to fuel system components of a gas turbine by fittings. The fittings each include a sealing arrangement that utilizes metal to metal contact in order to inhibit the leakage of fuel from the fitting. Referring to FIG. 1, a type of fitting that is frequently used includes a projecting cone portion 10 having a clearance surface 12 located between first 14 and second 16 cone sealing surfaces. The first 14 and second 16 sealing surfaces each taper toward a connection end 18 of the cone portion 10. The taper of the first sealing surface 14 is substantially identical to the taper of the second sealing surface 16.

In use, the cone portion 10 is received by a receptacle portion of the fitting. The receptacle portion includes a cavity having a tapered receptacle sealing surface which corresponds to the taper of the first 14 and second 16 sealing surfaces. When a fuel supply line is attached to a fuel system component, the first 14 and second 16 sealing surfaces come in contact with the receptacle sealing surface and form a seal. It is noted that the clearance surface 12 is located beneath the plane of first 14 and second 16 sealing surfaces. Thus, the clearance surface 12 does not contact the receptacle sealing surface and does not provide any sealing functionality.

Sections of the first 14 and/or second 16 sealing surfaces and/or clearance surface 12 may become damaged as a result of accidental contact with another component or equipment. For example, this may occur if the fuel line is accidentally dropped by an operator during assembly operations. In particular, FIG. 1 depicts damage in the form of an exemplary first 20 and second 21 gouges formed on the first sealing surface 14 and the clearance surface 12, respectively.

Referring to FIG. 2, a cross sectional view of the first sealing surface 14, a receptacle sealing surface 22 and gouge 20 is shown. Formation of the gouge 20 typically results in material from the first sealing surface 14 being displaced and reshaped into raised bulges 24. The bulges 24 cause misalignment between the first sealing surface 14 and the receptacle sealing surface 22 in the area of the bulges 24, thus resulting in a compromised seal and the possibility of fuel leaks.

A damaged portion of a fitting, such as cone portion 10, is replaced by cutting the cone portion 10 from the fuel line and welding a new cone portion 10 in its place. The weld then undergoes an x-ray inspection procedure to verify that welding requirements are met. However, welding requires a qualified welder and a hot work permit. In addition, performing an x-ray inspection requires a certified technician and the clearance of personnel from the work area in order to prevent exposure to x-rays. Further, there is a long wait time in obtaining replacement fittings. As such, the current process for replacing a damaged fitting is expensive and time consuming.

SUMMARY OF THE INVENTION

A lapping tool for lapping sealing surfaces of a fitting used in a gas turbine is disclosed. The tool includes a shaft having first and second ends and a longitudinal axis. A removable handle is attached to the first end and is oriented in a direction transverse to the axis. The tool also includes a removable lapping insert having an outwardly extending attachment portion that is attached to the second end of the shaft. The lapping insert includes a lapping surface which corresponds to the shape of a sealing surface of the fitting. In one embodiment, the lapping insert includes a cavity for receiving a cone portion of a fitting. Alternatively, the lapping insert includes a projection for insertion into a receptacle portion of a fitting.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIG. 3 is a perspective view of a lapping tool in accordance with the present invention.

FIG. 4 is a cross sectional view of a lapping tool in accordance with the present invention.

FIG. 5 is a cross sectional view of a second lapping insert.

FIG. 6 is a view of the cone portion of FIG. 1 after bulges formed on a first sealing surface have been removed.

FIG. 7 is a cross sectional view of a bluing tool.

DETAILED DESCRIPTION OF THE INVENTION

Figure 1:
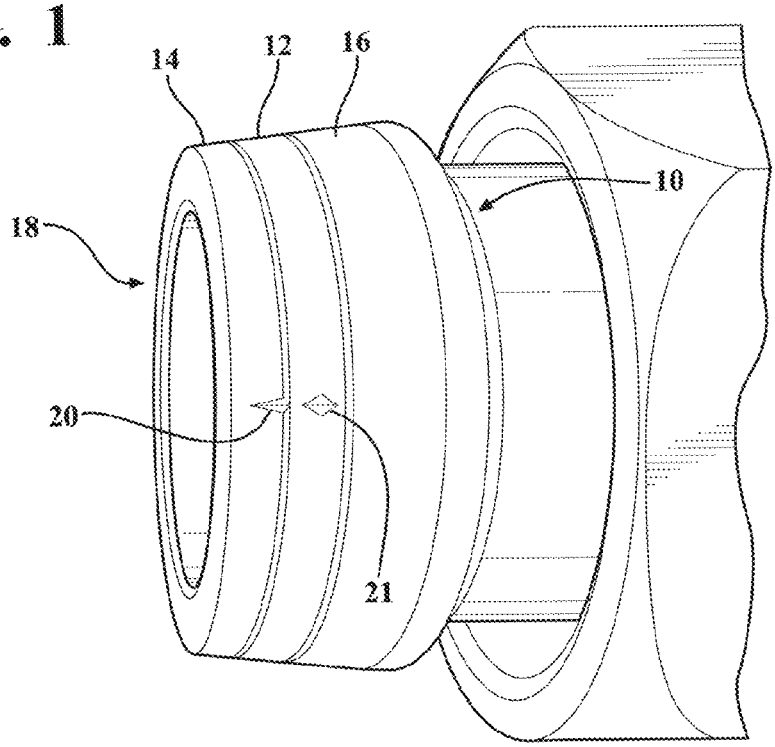
FIG. 1 depicts a cone portion of a fitting used in conjunction with a fuel line of a gas turbine.

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Referring to FIGS. 3 and 4, perspective and cross sectional views, respectively, are shown of a lapping tool 26 in accordance with the present invention. The tool 26 includes an elongated shaft 28 located between a handle 30 and a first lapping insert 32. The first insert 32 includes a housing 34 having an internal cavity wall 35 to define an internal cavity 36 for receiving a component or other item to be lapped. In one embodiment, a diameter of the cavity 36 decreases from an entry end 37 of the cavity 36 to an end wall 38 in accordance with a taper angle θ to form a tapered cavity. The cavity 36 is shaped to correspond with the shape of an item to be lapped such that the internal cavity wall 35 serves as a lapping surface. For example, the cavity 36 may be shaped to correspond to the shape of the cone portion 10 of a fuel line fitting. Further, the cavity 36 may have a taper angle of approximately 24 degrees, for example. In a preferred embodiment, the shaft 28, handle 30 and first lapping insert 32 are fabricated from aluminum. Alternatively, copper may be used.

A first end 40 of the shaft 28 includes a first hole 42 oriented along a longitudinal axis 44 of the shaft 28. The first insert 32 includes an outwardly extending attachment portion 46 which is received by the first hole 42. A fastener 48 extends through the shaft 28 in a direction transverse to the axis 44 and abuts against the attachment portion 46 to removably attach the first insert 32 to the shaft 28. This enables removal of the first insert 32 and replacement with a first insert 32 having a cavity 36 that has a different size, shape or taper angle or combinations thereof.

The handle 30 extends through a through hole 50 located on a second end 41 of the shaft and is oriented in a direction transverse to the axis 44. A fastener 52 extends through the shaft 28 and abuts against the handle 30 to removably attach the handle 30 to the shaft 28. The handle 30 may be grasped by an operator to enable clockwise and counterclockwise rotation of the shaft 28 and thus the housing 34 about the axis 44. In addition, the handle 30 may be replaced by a longer handle in order to provide additional leverage for rotating the shaft 28 or by a shorter handle due to space limitations. Further, the shaft 28 may be knurled in order to assist in holding and stabilizing the shaft 28 while the shaft 28 is being rotated.

Referring to FIG. 5, a cross sectional view of a second lapping insert 54 is shown. The second insert 54 includes a head portion 56 and the previously described attachment portion 46. A diameter of the head portion 56 increases from a lead end 58 to a base end 60 in accordance with a taper angle to form a tapered projection 62 having a tapered outer wall 64. The projection 62 is shaped to correspond with the shape of a receptacle sealing surface to be lapped such that the outer wall 64 serves as a lapping surface. For example, the projection 62 may be shaped to correspond to a tapered receptacle sealing surface 22 of a receptacle portion of a fuel line fitting. In use, the lead end 58 is inserted into the cavity of the receptacle portion in order to lap receptacle sealing surface 22. The second insert 54 is removably attached to the shaft 28 by the attachment portion 46 and the fastener 48 as previously described. This enables removal of the second insert 54 and replacement with a second insert 54 having a projection 62 that has a different size, shape or taper angle or combinations thereof.

The tool 26 is used in conjunction with a paste impregnated with abrasive particles, i.e. a lapping compound, to remove raised material from a surface in order to provide a smooth surface finish. The lapping compound is applied between a surface to be lapped and the internal cavity wall 35 of the first insert 32 or the outer wall 64 of the second insert 54. The tool 26 is then rotated by hand using the handle 30 in partial clockwise and counterclockwise directions in an oscillating motion to remove raised material on the surface in order to provide a relatively smooth surface. The surface may also be lapped in a plurality of sequential stages, at first using relatively course abrasive particles and subsequently using progressively finer abrasive particles until a desired smooth surface finish is achieved.

Figure 2:
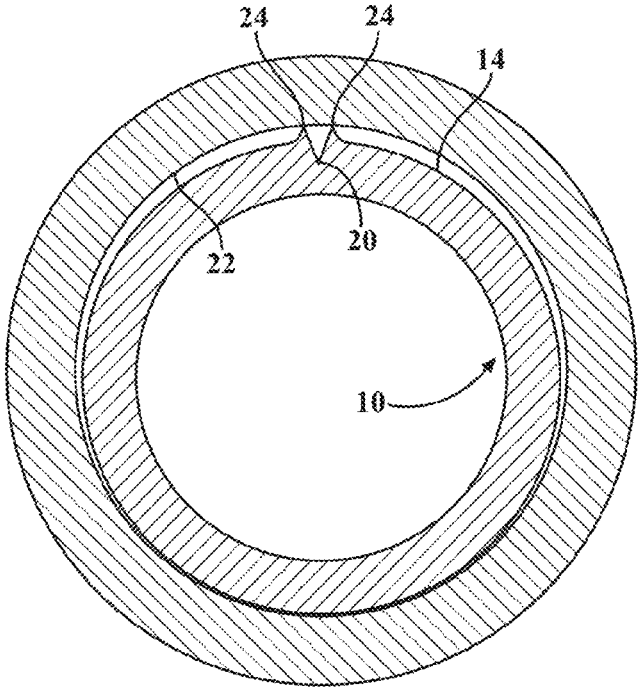
FIG. 2 is a cross sectional view of a receptacle sealing surface and a gouge formed on a first sealing surface.

In one embodiment, the tool 26 is used to lap a cone portion of a fitting used in a gas turbine such as cone portion 10 previously described in relation to FIGS. 1 and 2. For example, the first sealing surface 14 may become damaged as a result of accidental contact with another component or equipment resulting in the first gouge 20 and associated raised bulges 24. In order to remove bulges 24 from the first sealing surface 14, the first insert 32 is attached to the first end 40 of the shaft 28. A medium grade lapping compound is then applied to the first 14 and second 16 sealing surfaces and the internal cavity wall 35. Next, the cone portion 10 is inserted into the entry end 37 of the cavity 36. The tool 26 is then rotated in partial clockwise and counterclockwise directions in an oscillating motion as previously described while the cone portion 10 is firmly held. It is noted that only slight pressure along the axis is necessary. It is important that sufficient lapping compound is used such that no metal to metal contact occurs between the first 14 and second 16 sealing surfaces and the internal cavity wall 35. The rotations of the tool 26 are continued until a rough surface finish is achieved. The medium grade polish is then completely removed from the first 14 and second 16 sealing surfaces and the internal cavity wall 35 of the first insert 32. Next, the first 14 and second 16 sealing surfaces are lapped using a fine grade lapping compound in order to provide a desired smooth surface finish. When this is complete, the lapping compound is completely cleaned from the cone portion 10.

Referring to FIG. 6, a view of the cone portion 10 is shown after the raised material from the bulges 24 adjacent to the first gouge 20 have been removed to provide a smooth surface finish on the first 14 sealing surface. It is noted that the current invention may also be used to remove bulges from the second sealing surface 16 or both the first 14 and second 16 sealing surfaces simultaneously. Further, although the clearance surface 12 is located beneath the plane of first 14 and second 16 sealing surfaces, portions of any raised material or bulges formed on the clearance surface 12 which extend beyond the plane of the first 14 and second 16 sealing surfaces are also smoothed by the first insert 32.

Referring to FIG. 7, a cross sectional view of a bluing tool 66 is shown. The bluing tool 66 serves as a reference tool for checking the smoothness of a surface, such as the receptacle sealing surface 22. The bluing tool 66 includes a reference portion 68 and the previously described attachment portion 46. A diameter of the reference portion 68 increases from a lead end 70 to a base end 72 in accordance with a taper angle to form a tapered reference head 74 having a tapered outer wall 76. The bluing tool 66 is removably attached to the shaft 28 by the attachment portion 46 and the fastener 48 as previously described. This enables removal of the bluing tool 66 and replacement with a bluing tool 66 having a reference portion 68 that has a different size, shape or taper angle or combinations thereof.

The bluing tool 66 is used in conjunction with a paste known as engineer's blue to determine whether a high spot exists on a surface. In use, the paste is applied to the bluing tool 66. The lead end 70 of the bluing tool 66 is then inserted into the cavity of the receptacle portion of a fitting. Any high spots on the receptacle sealing surface 22 contacts the bluing tool 66. This causes a portion of the engineer's blue that is contacted by a high spot to transfer to the high spot, thus indicated the location of the high spot. A lapping procedure may then be used to reduce the high spot. In one embodiment, the bluing tool 66 is fabricated from tool steel in order to avoid galling or other damage to the receptacle sealing surface 22.

Thus, the first 32 and second 54 inserts and the bluing tool 66 may each be removably attached to the shaft 28. This enables lapping of the first 14 and second 16 sealing surfaces of cone portion 10 and the receptacle sealing surface 22 of a receptacle portion, in addition to checking for high spots in a sealing surface, through the use of a single tool. Further, the tool 26 enables repair of a fitting of a gas turbine thereby eliminating the need to remove the fitting and welding a new fitting in its place, thus avoiding associated costs and time delays.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A lapping tool for lapping sealing surfaces of a fitting used in a gas turbine, comprising:

a shaft having first and second ends and a longitudinal axis;

a removable handle attached to the second end of the shaft; and first and second removable lapping inserts, each having an outwardly extending attachment portion for attachment to the first end of the shaft, wherein the lapping inserts each include a lapping surface which corresponds to the shape of a sealing surface of the fitting and wherein:

the first lapping insert includes a cavity defining a tapered lapping surface for receiving and lapping an exterior surface of a first portion of the fitting; and the second lapping insert includes a projection defining a tapered lapping surface for insertion into and lapping an interior surface in a second portion of the fitting, wherein the second portion of the fitting forms a receptacle portion for sealingly receiving the first portion of the fitting.

2. The lapping tool according to claim 1, wherein the shaft includes a hole for receiving the attachment portion.

3. The lapping tool according to claim 2, wherein the attachment portion is secured to the shaft by a removable fastener.

4. The lapping tool according to claim 1, wherein the lapping surfaces are tapered at an angle of approximately 24 degrees.

5. The lapping tool according to claim 1, wherein a lapping compound is applied between the lapping surface and the sealing surface.

6. A method for lapping first and second portions of a fitting, comprising:

attaching a removable first lapping insert to a shaft, wherein the first lapping insert is configured to lap a sealing surface of the first portion;

lapping the sealing surface of the first portion of the fitting;

removing the first lapping insert from the shaft;

attaching a removable second lapping insert to the shaft, wherein the second lapping insert is configured to lap a sealing surface of the second portion;

lapping the sealing surface of the second portion of the fitting;

removing the second lapping insert from the shaft;

attaching a reference tool to the shaft; and checking for high spots on a lapped sealing surface.

7. The method according to claim 6, further including applying a lapping compound between the first and second lapping inserts and the sealing surfaces of the first and second portions, respectively.

8. The method according to claim 6, the first lapping insert includes cavity for receiving a first portion of the fitting.

9. The method according to claim 8, wherein the cavity is tapered.

10. The method according to claim 9, wherein the cavity is tapered at an angle of approximately 24 degrees.

11. The method according to claim 6, wherein the second lapping insert includes a projection for insertion into a cavity of a second portion of the fitting.

12. The method according to claim 11, wherein the projection is tapered.

13. The method according to claim 6 further including providing an attachment portion for the first and second lapping inserts.

* * * * *